US010227842B2

(12) United States Patent
Kellner et al.

(10) Patent No.: US 10,227,842 B2
(45) Date of Patent: Mar. 12, 2019

(54) FRICTION-LOCK FRAC PLUG

(71) Applicant: TEAM OIL TOOLS, LP, The Woodlands, TX (US)

(72) Inventors: Justin Kellner, Adkins, TX (US); Carl Martin, The Woodlands, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 113 days.

(21) Appl. No.: 15/378,185

(22) Filed: Dec. 14, 2016

(65) Prior Publication Data

US 2018/0163492 A1 Jun. 14, 2018

(51) Int. Cl.

| | |
|---|---|
| ***E21B 23/01*** | (2006.01) |
| ***E21B 33/129*** | (2006.01) |
| ***E21B 34/14*** | (2006.01) |

(52) U.S. Cl.

CPC ..... *E21B 33/1293* (2013.01); *E21B 23/01* (2013.01); *E21B 33/129* (2013.01); *E21B 34/14* (2013.01)

(58) Field of Classification Search

CPC ..... E21B 23/01; E21B 33/129; E21B 34/14
See application file for complete search history.

(56) References Cited

U.S. PATENT DOCUMENTS

| | | | |
|---|---|---|---|
| 2,189,697 | A | 2/1940 | Baker |
| 2,222,233 | A | 11/1940 | Mize |
| 2,225,143 | A | 12/1940 | Baker et al. |
| 4,483,399 | A | 11/1984 | Colgate |
| 4,901,794 | A | 2/1990 | Baugh et al. |
| 5,131,468 | A | 7/1992 | Lane et al. |
| 5,325,923 | A | 7/1994 | Surjaatmadja et al. |
| 5,396,957 | A | 3/1995 | Surjaatmadja et al. |
| 5,479,986 | A | 1/1996 | Gano et al. |
| 5,623,993 | A | 4/1997 | Buskirk et al. |
| 5,709,269 | A | 1/1998 | Head |

(Continued)

FOREIGN PATENT DOCUMENTS

| | | | |
|---|---|---|---|
| AR | 091776 | A1 | 2/2015 |
| AU | 2010214651 | A1 | 3/2012 |

(Continued)

OTHER PUBLICATIONS

Zhang et al., High Strength Nanostructured Materials and Their Oil Field Applications, SPE 157092, SPE International, 2012, pp. 1-6.

(Continued)

*Primary Examiner* — Giovanna C. Wright
(74) *Attorney, Agent, or Firm* — MH2 Technology Law Group LLP

(57) ABSTRACT

A downhole tool includes an upper wedge member and a lower wedge member. The upper and lower wedge members each have a circumferential width that decreases proceeding from an outer axial end thereof to an inner axial end thereof. As the downhole tool actuates from a first state to a second state, the upper and lower wedge members move axially with respect to a central longitudinal axis through the downhole tool, the upper and lower wedge members move radially-outward with respect to the central longitudinal axis, and the upper and lower wedge members remain coupled to one another as the upper and lower wedge members move.

18 Claims, 8 Drawing Sheets

(56) References Cited

U.S. PATENT DOCUMENTS 6,354,373 B1 3/2002 Vercaemer et al.
6,446,323 B1 9/2002 Metcalfe et al.
6,662,876 B2 12/2003 Lauritzen
6,684,958 B2 2/2004 Williams et al.
6,702,029 B2 3/2004 Metcalfe et al.
6,722,437 B2 4/2004 Vercaemer et al.
7,093,656 B2 8/2006 Maguire
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burris, II et al.
7,350,582 B2 4/2008 McKeachnie et al.
7,350,588 B2 4/2008 Abercrombie Simpson et al.
7,363,967 B2 4/2008 Burris, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Halley, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
8,016,032 B2 9/2011 Mandrell et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,026 B2 11/2013 Mailand et al.
8,631,876 B2 1/2014 Xu et al.
8,636,074 B2 1/2014 Nutley et al.
8,684,096 B2 4/2014 Harris et al.
8,776,884 B2 7/2014 Xu et al.
8,905,149 B2 12/2014 Bailey et al.
8,936,085 B2 1/2015 Boney et al.
8,950,504 B2 2/2015 Xu et al.
8,978,776 B2 3/2015 Spray
9,010,416 B2 4/2015 Xu et al.
9,016,363 B2 4/2015 Xu et al.
9,033,041 B2 5/2015 Baihly et al.
9,033,060 B2 5/2015 Xu et al.
9,057,260 B2 6/2015 Kelbie et al.
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,309,733 B2 4/2016 Xu et al.
9,334,702 B2 5/2016 Allen et al.
9,382,790 B2 7/2016 Bertoja et al.
9,574,415 B2 2/2017 Xu et al.
9,605,508 B2 3/2017 Xu et al.
9,752,423 B2 9/2017 Lynk
9,909,384 B2 3/2018 Chauffe et al.
9,976,381 B2 5/2018 Martin et al.
10,156,119 B2 12/2018 Martin et al.
2003/0062171 A1 4/2003 Maguire et al.
2003/0188876 A1* 10/2003 Vick ..... E21B 33/1208 166/382
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.
2005/0199401 A1 9/2005 Patel et al.
2005/0205266 A1 9/2005 Todd et al.
2005/0211446 A1 9/2005 Ricalton et al.
2005/0217866 A1 10/2005 Watson et al.
2006/0185855 A1 8/2006 Jordan et al.
2007/0000664 A1 1/2007 Ring et al.
2007/0044958 A1 3/2007 Rytlewski et al.
2007/0272418 A1 11/2007 Corre et al.
2008/0066923 A1 3/2008 Xu
2008/0073074 A1 3/2008 Frazier
2008/0135248 A1 6/2008 Talley et al.
2008/0142223 A1 6/2008 Xu et al.
2009/0038808 A1* 2/2009 Anderson ..... E21B 23/01 166/382
2009/0044949 A1 2/2009 King et al.
2009/0065196 A1 3/2009 Holland et al.
2009/0242213 A1 10/2009 Braddick
2009/0266560 A1 10/2009 Ring et al.
2010/0032167 A1 2/2010 Adam et al.
2010/0116489 A1 5/2010 Nelson
2010/0170682 A1 7/2010 Brennan et al.
2010/0270031 A1 10/2010 Patel
2010/0270035 A1 10/2010 Ring et al.
2010/0276159 A1 11/2010 Mailand et al.
2010/0314127 A1 12/2010 Swor et al.
2010/0319427 A1 12/2010 Lohbeck
2010/0319927 A1 12/2010 Yokley et al.
2011/0005779 A1 1/2011 Lembcke
2011/0048743 A1 3/2011 Stafford et al.
2011/0132143 A1 6/2011 Xu et al.
2011/0132619 A1 6/2011 Agrawal et al.
2011/0132621 A1 6/2011 Agrawal et al.
2011/0132623 A1 6/2011 Moeller
2011/0240295 A1 10/2011 Porter et al.
2011/0266004 A1 11/2011 Hallundbaek et al.
2011/0284232 A1 11/2011 Huang
2012/0024109 A1 2/2012 Xu et al.
2012/0055669 A1 3/2012 Levin et al.
2012/0067583 A1 3/2012 Zimmerman et al.
2012/0111566 A1 5/2012 Sherman et al.
2012/0118583 A1 5/2012 Johnson et al.
2012/0132426 A1 5/2012 Xu et al.
2012/0168163 A1 7/2012 Bertoja et al.
2012/0199341 A1 8/2012 Kellner et al.
2012/0205873 A1 8/2012 Turley
2012/0247767 A1 10/2012 Themig et al.
2012/0273199 A1 11/2012 Cresswell et al.
2013/0008671 A1 1/2013 Booth
2013/0062063 A1 3/2013 Baihly et al.
2013/0081825 A1 4/2013 Lynde et al.
2013/0186615 A1 7/2013 Hallubaek et al.
2013/0186616 A1 7/2013 Xu et al.
2013/0186650 A1* 7/2013 Xu ..... E21B 23/01 166/386
2013/0299185 A1 11/2013 Xu et al.
2014/0014339 A1 1/2014 O'Malley et al.

(56) References Cited

U.S. PATENT DOCUMENTS

| | | | | |
|---|---|---|---|---|
| 2014/0076571 | A1 | 3/2014 | Frazier et al. | |
| 2014/0216759 | A1* | 8/2014 | Jacob | E21B 23/00 166/382 |
| 2015/0068757 | A1 | 3/2015 | Hofman et al. | |
| 2015/0075774 | A1 | 3/2015 | Raggio | |
| 2015/0129215 | A1 | 5/2015 | Xu et al. | |
| 2015/0184485 | A1 | 7/2015 | Xu et al. | |
| 2015/0218904 | A1 | 8/2015 | Chauffe et al. | |
| 2016/0160591 | A1 | 6/2016 | Xu et al. | |
| 2016/0186511 | A1 | 6/2016 | Coronado et al. | |
| 2016/0305215 | A1 | 10/2016 | Harris et al. | |
| 2016/0312557 | A1 | 10/2016 | Kitzman | |
| 2017/0101843 | A1 | 4/2017 | Waterhouse et al. | |
| 2017/0130553 | A1 | 5/2017 | Harris et al. | |
| 2018/0266205 | A1 | 9/2018 | Martin et al. | |

FOREIGN PATENT DOCUMENTS

| | | | |
|---|---|---|---|
| EP | 2251525 | A1 | 11/2010 |
| GB | 2345308 | A | 7/2000 |
| GB | 2448449 | B | 12/2008 |
| GB | 2482078 | A | 1/2012 |
| WO | 2010039131 | A1 | 4/2010 |
| WO | 2011/023743 | A2 | 11/2011 |
| WO | 2011/137112 | A2 | 11/2011 |
| WO | 2014014591 | A1 | 1/2014 |
| WO | 2014/100072 | A1 | 6/2014 |
| WO | 2016/160003 | A1 | 10/2016 |
| WO | 2017/151384 | A1 | 9/2017 |

OTHER PUBLICATIONS

Xu et al., Smart Nanostructured Materials Deliver High Reliability Completion Tools for Gas Shale Fracturing, SPE 146586, SPE International, 2011, pp. 1-6.
Larimore et al., Overcoming Completion Challenges with Interventionless Devices—Case Study—The "Disappearing Plug", SPE 63111, SPE International, 2000, pp. 1-13.
King et al., A Methodology for Selecting Interventionless Packer Setting Techniques, SPE-90678-MS, Society of Petroleum Engineers, 2004, pp. 1-3.
Xu et al., Declaration Under 37 CFR 1.132, U.S. Appl. No. 14/605,365, filed Jan. 26, 2015, pp. 1-4.
Non-Final Office Action dated May 20, 2014, U.S. Appl. No. 13/466,322, filed May 8, 2012, pp. 1-111.
Notice of Allowance dated Sep. 16, 2014, U.S. Appl. No. 13/466,322, filed May 8, 2012, pp. 1-10.
Notice of Allowance dated Oct. 29, 2014, U.S. Appl. No. 13/466,322, filed May 8, 2012, pp. 1-10.
Non-Final Office Action dated Aug. 1, 2014, U.S. Appl. No. 13/358,317, filed Jan. 25, 2012, pp. 1-15.
Notice of Allowance dated Jan. 9, 2015, U.S. Appl. No. 13/358,317, filed Jan. 25, 2012, pp. 1-7.
Non-Final Office Action dated Jul. 30, 2014, U.S. Appl. No. 13/466,329, filed May 8, 2012, pp. 1-16.
Final Office Action dated Dec. 18, 2014, U.S. Appl. No. 13/466,329, filed May 8, 2012, pp. 1-12.
Notice of Allowance dated Mar. 11, 2015, U.S. Appl. No. 13/466,329, filed May 8, 2012, pp. 1-5.
Non-Final Office Action dated Nov. 26, 2014, U.S. Appl. No. 13/358,307, filed Jan. 25, 2012, pp. 1-17.
Notice of Allowance dated Mar. 25, 2015, U.S. Appl. No. 13/358,307, filed Jan. 25, 2012, pp. 1-12.
Non-Final Office Action dated Oct. 6, 2014, U.S. Appl. No. 13/358,332, filed Jan. 25, 2012, pp. 1-15.
Notice of Allowance dated Apr. 7, 2015, U.S. Appl. No. 13/358,332, filed Jan. 25, 2012, pp. 1-8.
Non-Final Office Action dated Mar. 17, 2015, U.S. Appl. No. 13/705,972, filed Dec. 5, 2012, pp. 1-23.
Final Office Action dated Oct. 2, 2015, U.S. Appl. No. 13/705,972, filed Dec. 5, 2012, pp. 1-20.
Advisory Action dated Nov. 20, 2015, U.S. Appl. No. 13/705,972, filed Dec. 5, 2012, pp. 1-4.
Notice of Allowance dated Jan. 29, 2016, U.S. Appl. No. 13/705,972, filed Dec. 5, 2012, pp. 1-5.
Non-Final Office Action dated Jan. 15, 2016, U.S. Appl. No. 14/605,365, filed Jan. 26, 2015, pp. 1-10.
Final Office Action dated Jun. 22, 2016, U.S. Appl. No. 14/605,365, filed Jan. 26, 2015, pp. 1-15.
Advisory Action dated Sep. 21, 2016, U.S. Appl. No. 14/605,365, filed Jan. 26, 2015, pp. 1-4.
Notice of Allowance dated Dec. 19, 2016, U.S. Appl. No. 14/605,365, filed Jan. 26, 2015, pp. 1-7.
Non-Final Office Action dated Jun. 23, 2014, U.S. Appl. No. 13/466,311, filed May 8, 2012, pp. 1-12.
Non-Final Office Action dated Dec. 9, 2014, U.S. Appl. No. 13/466,311, filed May 8, 2012, pp. 1-12.
Non-Final Office Action dated Jun. 25, 2015, U.S. Appl. No. 13/466,311, filed May 8, 2012, pp. 1-17.
Final Office Action dated Dec. 9, 2015, U.S. Appl. No. 13/466,311, filed May 8, 2012, pp. 1-97.
Non-Final Office Action dated Feb. 22, 2016, U.S. Appl. No. 13/466,311, filed May 8, 2012, pp. 1-10.
Final Office Action dated Sep. 6, 2016, U.S. Appl. No. 13/466,311, filed May 8, 2012, pp. 1-24.
Advisory Action dated Dec. 6, 2016, U.S. Appl. No. 13/466,311, filed May 3, 2012, pp. 1-4.
Notice of Allowance dated Feb. 1, 2017, U.S. Appl. No. 13/466,311, filed May 8, 2012, pp. 1-8.
Tae Wook Park (Authorized Officer), International Search Report and Written Opinion dated Nov. 4, 2016, PCT Application No. PCT/US2016/043545, filed Jul. 22, 2016, pp. 1-18.
Hinkie et al., "Multizone Completion with Accurately Placed Stimulation Through Casing Wall", SPE Production and operations Symposium, Mar. 31-Apr. 3, 2007, pp. 1-4.
Anjum et al., "Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way", SPE International Oil & Gas Conference, Jun. 8-10, 2010, pp. 1-16.
Vargus et al., "Completion System Allows for Interventionless Stimulation Treatments in Horizontal Wells with Multiple Shale Pay Zones", SPE Annual Technical Conference, Sep. 2008, pp. 1-8.
Gorra et al., "Expandable Zonal Isolation Barrier (ZIB) Provides a Long-Term Well Solution as a High Differential Pressure Metal Barrier to Flow", Brazilian Petroleum Technical Papers, 2010, Abstract only, 1 page.
Vargus et al., "System Enables Multizone Completions", The American Oil & Gas Reporter, 2009, Abstract only, 1 page.
Vargus et al., "Completion System Allows for Interventionless Stimulation Treatments in Horiziontal Wells with Multiple Shale Pay Zones", Annual SPE Technical Conference, Sep. 2008, Abstract only, 1 page.
Tae Wook Park (Authorized Officer), International Search Report and Written Opinion dated Nov. 1, 2018, PCT Application No. PCT/US2018/042993, filed Jul. 20, 2018, pp. 1-14.

* cited by examiner

FRICTION-LOCK FRAC PLUG

BACKGROUND

A downhole plug is designed to provide zonal isolation in a wellbore (i.e., to isolate a portion of the wellbore above the plug from a portion of the wellbore below the plug). One type of plug includes a mandrel having a bore formed therethrough, which may be plugged by an obstruction such as a ball, or may have a permanent obstruction or "bridge" therein.

The plug is typically secured in place (or "set") in the wellbore by actuating a setting assembly. For example, a slip, a cone, and a sealing element are positioned around the mandrel. When the plug is in the desired position in the wellbore, a setting tool may apply opposing axial forces on the plug that cause the slip to slide along an inclined outer surface of the cone, which pushes the slip radially-outward. As the slip moves radially-outward, teeth on the outer surface of the slip may engage a surrounding tubular (e.g., a liner, a casing, a wall of the wellbore, etc.) to secure the plug in place in the wellbore. The opposing axial forces generated by the setting tool may also cause the sealing element to expand radially-outward to contact the surrounding tubular. When in contact with the surrounding tubular, the sealing element may prevent fluid from flowing axially through an annulus formed between the mandrel and the surrounding tubular.

SUMMARY

A downhole tool is disclosed. The downhole tool includes an upper wedge member and a lower wedge member. The upper and lower wedge members each have a circumferential width that decreases proceeding from an outer axial end thereof to an inner axial end thereof. As the downhole tool actuates from a first state to a second state, the upper and lower wedge members move axially with respect to a central longitudinal axis through the downhole tool, the upper and lower wedge members move radially-outward with respect to the central longitudinal axis, and the upper and lower wedge members remain coupled to one another as the upper and lower wedge members move.

In another embodiment, the downhole tool includes a plurality of upper wedge members and a plurality of lower wedge members. Each of the upper wedge members is positioned circumferentially-between two of the lower wedge members. Each of the upper and lower wedge members has a circumferential width that decreases proceeding from an outer axial end thereof to an inner axial end thereof. As the downhole tool actuates from a first state to a second state, the upper and lower wedge members move axially with respect to a central longitudinal axis through the downhole tool such that a length of the downhole tool decreases, the upper and lower wedge members move radially-outward with respect to the central longitudinal axis such that a diameter of the downhole tool increases, and the upper and lower wedge members remain coupled to one another one another as the upper and lower wedge members move.

A method for actuating a downhole tool in a wellbore is also disclosed. The method includes running the downhole tool into the wellbore in a first state. The downhole tool includes a plurality of upper wedge members and a plurality of lower wedge members. Each of the upper wedge members is positioned circumferentially-between two of the lower wedge members. Each of the upper and lower wedge members has a circumferential width that decreases proceeding from an outer axial end thereof to an inner axial end thereof. The method also includes actuating the downhole tool from a first state into a second state by exerting a downward axial force on the upper wedge members and an upward axial force on the lower wedge members. As the downhole tool actuates from the first state to the second state, the upper and lower wedge members move axially with respect to a central longitudinal axis through the downhole tool such that a length of the downhole tool decreases, the upper and lower wedge members move radially-outward with respect to the central longitudinal axis such that a diameter of the downhole tool increases, and the upper and lower wedge members remain coupled to one another one another as the upper and lower wedge members move.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
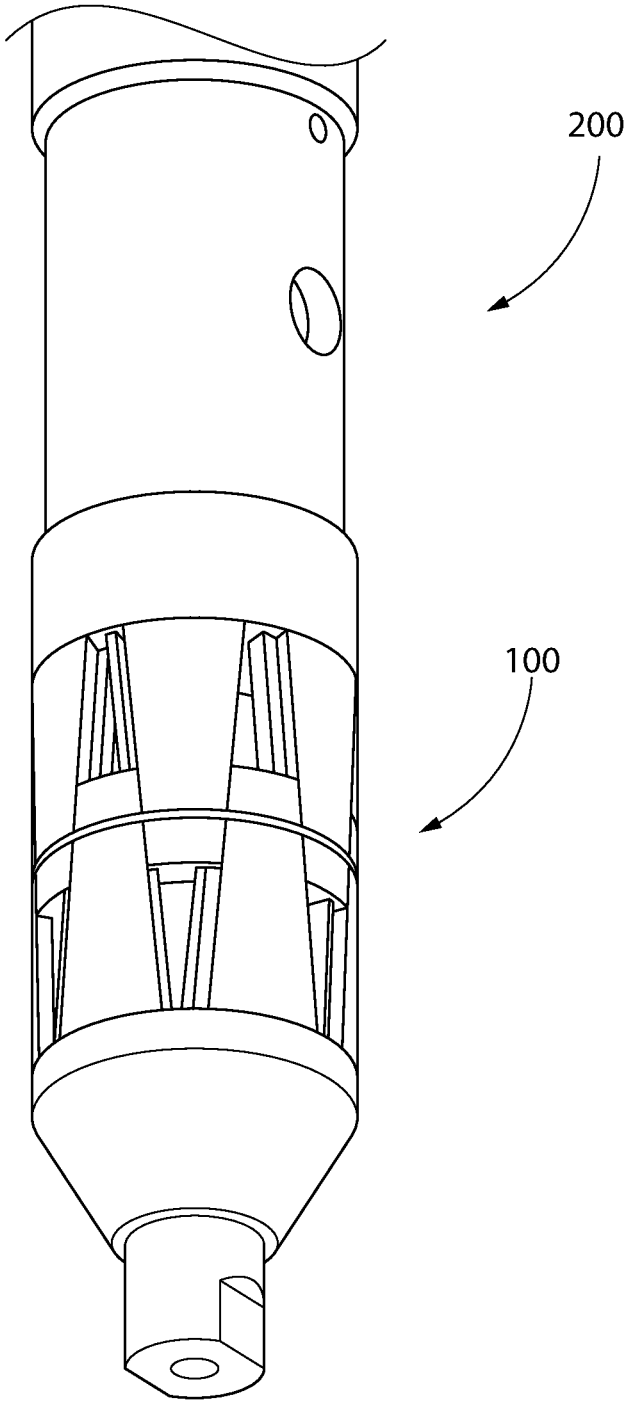
FIG. 1 illustrates a perspective view of a downhole tool in a first (e.g., unset) state and positioned at least partially around a setting tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides a downhole tool. The downhole tool may include a plurality of upper wedge members and a plurality of lower wedge members. The upper and lower wedge members each have a circumferential width that decreases proceeding from an outer axial end thereof to an inner axial end thereof. The downhole tool is configured to actuate from a first (e.g., unset) state to a second (e.g., set) state. When actuating, the upper and lower wedge members move axially with respect to one another along a central longitudinal axis through the downhole tool, the upper and lower wedge members move radially-outward with respect to the central longitudinal axis, and the upper and lower wedge members remain coupled to one another as the upper and lower wedge members move.

FIG. 1 illustrates a perspective view of a downhole tool 100 positioned at least partially around a setting tool 200, according to an embodiment. The downhole tool 100 may be or include a plug. For example, the downhole tool 100 may be or include a frac plug. However, unlike conventional plugs, the downhole tool 100 does not include a mandrel, slips, or cones. As described in greater detail below, the setting tool 200 may exert an axial force on the downhole tool 100 that causes the downhole tool 100 to expand radially-outward into contact with a surrounding tubular member such as a liner, a casing, a wellbore wall, etc.

Figure 2:
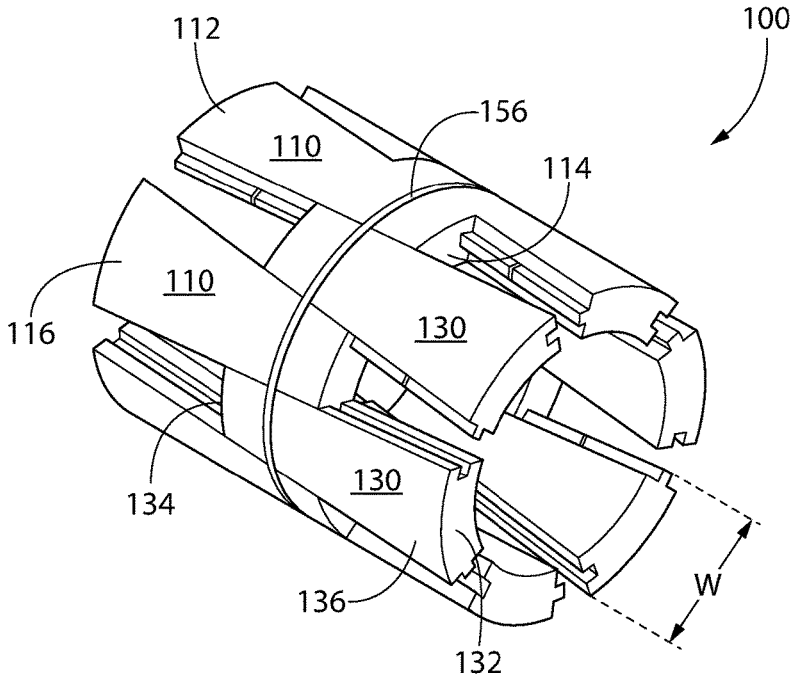
FIG. 2 illustrates a perspective view of the downhole tool in the first (e.g., unset) state, according to an embodiment.
Figure 3:
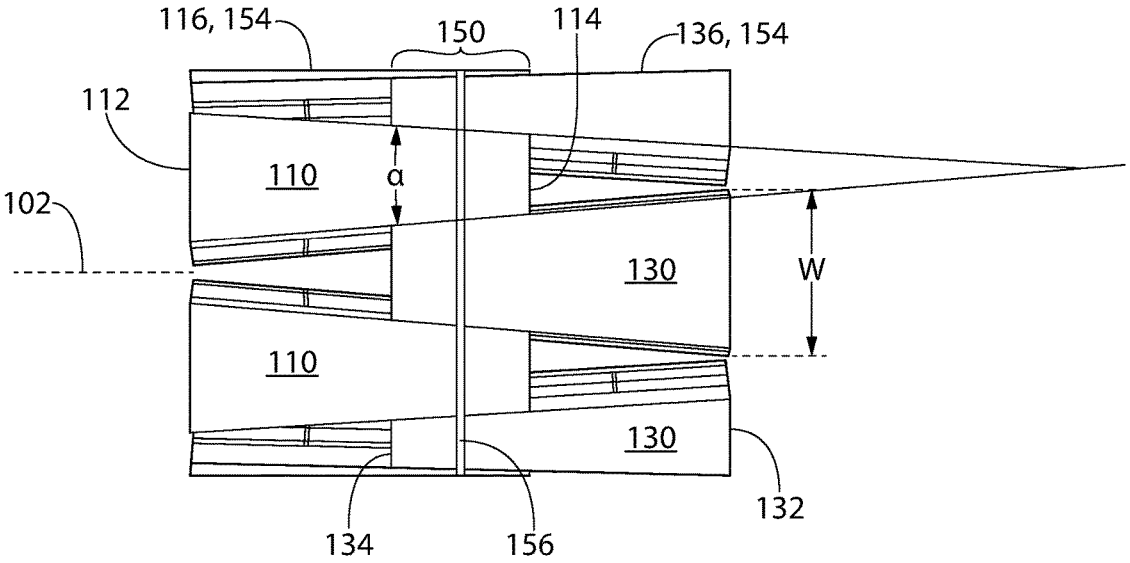
FIG. 3 illustrates a side view of the downhole tool in the first (e.g., unset) state, according to an embodiment.

FIGS. 2 and 3 illustrate a perspective view and a side view of the downhole tool 100 in a first (e.g., unset) state, according to an embodiment. The downhole tool 100 may include one or more first (e.g., upper) wedge members 110 and one or more second (e.g., lower) wedge members 130. The upper wedge members 110 may each include an outer axial end 112 and an inner axial end 114. Similarly, the lower wedge members 130 may each include an outer axial end 132 and an inner axial end 134. The inner axial ends 114, 134 of the upper and lower wedge members 110, 130 may face in opposing axial directions. In at least one embodiment, the upper wedge members 110 and/or the lower wedge members 130 may be made of a material that is configured to dissolve when in contact with a wellbore fluid for a predetermined amount of time.

The upper and/or lower wedge members 110, 130 may each generally be shaped as an tapered, arcuate segment. For example, a width W of the upper and/or lower wedge members 110, 130 may decrease proceeding from the outer axial ends 112, 132 thereof toward the inner axial ends 114, 134 thereof. The width W may also be referred to as the circumferential width W (e.g., with respect to a central longitudinal axis 102 through the downhole tool 100). An angle $\alpha$ between the sides of the upper and/or lower wedge members 110, 130 may be from about 4° to about 40°, about 6° to about 30°, or about 8° to about 20° (e.g., about 14°).

The upper wedge members 110 may be circumferentially-offset from one another about the central longitudinal axis 102. Similarly, the lower wedge members 130 may be circumferentially-offset from one another about the central longitudinal axis 102. As shown, the upper and lower wedge members 110, 130 may be circumferentially-alternating with one another about the central longitudinal axis 102. More particularly, each upper wedge member 110 may be positioned circumferentially-between two adjacent lower wedge members 130, and each lower wedge member 130 may be positioned circumferentially-between two adjacent upper wedge members 110.

When the downhole tool 100 is in the first (e.g., unset) state, the upper wedge members 110 may be axially-aligned with one another, and the lower wedge members 130 may be axially-aligned with one another, with respect to the central longitudinal axis 102. In addition, when the downhole tool 100 is in the first (e.g., unset) state, the upper wedge members 110 may be axially-offset from the lower wedge members 130, but the upper and lower wedge members 110, 130 may include axially-overlapping portions 150.

Due to the shape and positioning of the upper and/or lower wedge members 110, 130 when the downhole tool 100 is in the first (e.g., unset) state, a tapered gap may be defined by the sides of each adjacent pair of upper wedge members 110 and the inner axial end 132 of the lower wedge member 130 positioned circumferentially-between them. Similarly, a tapered gap may be defined by the sides of each adjacent pair of lower wedge members 130 and the inner axial end 112 of the upper wedge member 110 positioned circumferentially-between them.

Outer surfaces 116, 136 of the upper and/or lower wedge members 110, 130 may include a gripping feature 154 that is configured to create a high-friction engagement with (e.g., grip) the surrounding tubular. The gripping feature 154 may be or include teeth, wickers, grit, buttons, a high-friction coating, or a combination thereof.

The downhole tool 100 may also include a containment member 156 that holds the downhole tool 100 in the first (e.g., unset) state. As shown, the containment member 156 may be a rupture band that is positioned at least partially around the axially-overlapping portions 150 of the upper and lower wedge members 110, 130. In such an embodiment, the containment member 156 may be configured to rupture when exposed to a predetermined radially-outward force, which may be applied to initiate the setting process. In at least one embodiment, the outer surfaces 116 of the upper wedge members 110 may include a portion of a circumferential groove 117 (shown in FIG. 5), and the outer surfaces 136 of the lower wedge members 130 may include a portion of a circumferential groove 137 (shown in FIG. 6). The circumferential grooves 117, 137 may be in the axially-overlapping portions 150 of the upper and lower wedge members 110, 130. The circumferential grooves 117, 137 may together form continuous circumferential groove when the downhole tool 100 is in the first state, and the containment member 156 may be positioned at least partially within the continuous circumferential groove. The circumferential grooves 117, 137 may be axially-offset from one another when the downhole tool 100 is in the second state.

Figure 4:
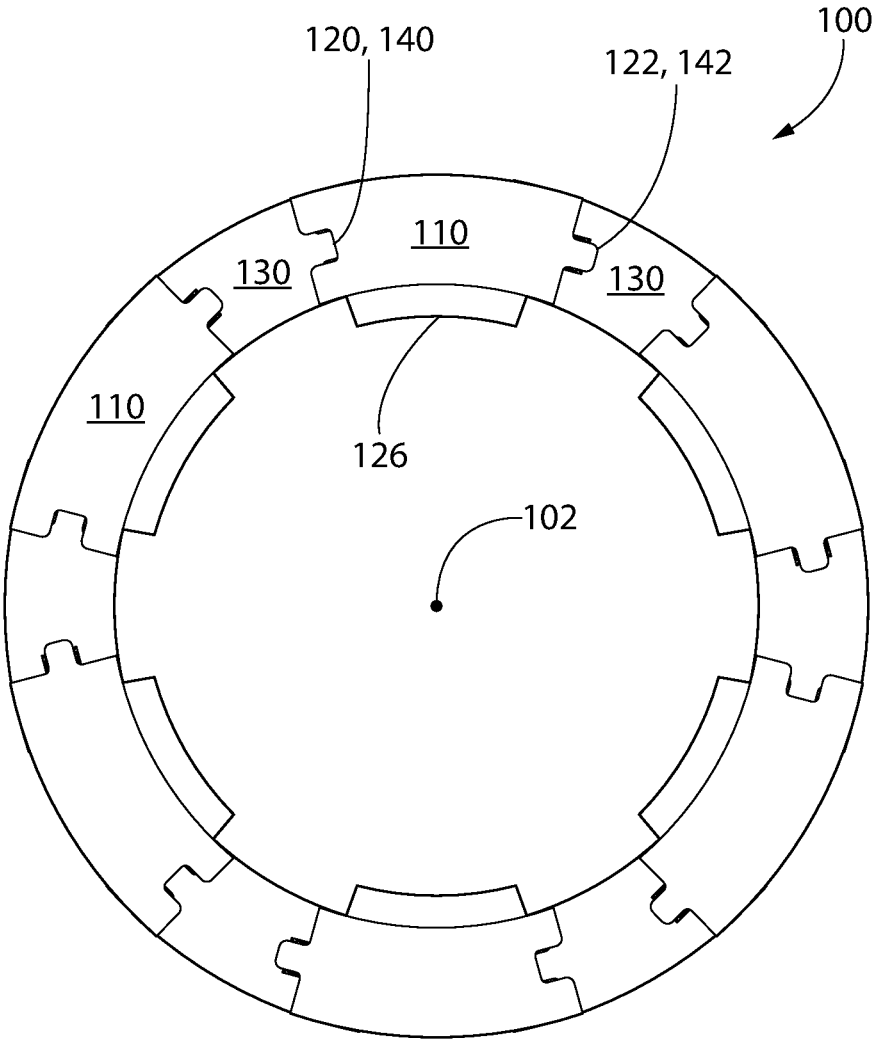
FIG. 4 illustrates an end view of the downhole tool in the first (e.g., unset) state, according to an embodiment.

FIG. 4 illustrates an end view of the downhole tool 100 in the first (e.g., unset) state, according to an embodiment. The view from the opposing axial end of the downhole tool 100 may be the same as the view in FIG. 4 or a mirror image of the view in FIG. 4. The sides of the upper wedge members 110 may include coupling features 120, 122. More particularly, a first side of each upper wedge member 110 may include a first coupling feature 120, and a second side of each upper wedge member 110 may include a second coupling feature 122. As shown, the first coupling features 120 are protrusions, and the second coupling features 122 are recesses.

The sides of the lower wedge members 130 may also include coupling features 140, 142. More particularly, a first side of each lower wedge member 130 may include a first coupling feature 140, and a second side of each lower wedge member 130 may include a second coupling feature 142. As shown, the first coupling features 140 are recesses, and the second coupling features 142 are protrusions.

As shown, the first coupling feature (e.g., protrusion) 120 of each upper wedge member 110 may be coupled with (e.g., positioned within) the corresponding first coupling feature (e.g., recess) 140 of the adjacent lower wedge member 130. Similarly, the second coupling feature (e.g., recess) 122 of each upper wedge member 110 may be coupled with (e.g., receive) the corresponding second coupling feature (e.g., protrusion) 142 of the adjacent lower wedge member 130. The coupling features 120, 122, 140, 142 may allow the upper and lower wedge members 110, 130 to move axially and radially with respect to the central longitudinal axis 102 while still remaining coupled with one another.

Although not shown, in at least one embodiment, the first and second coupling features 120, 122 of the upper wedge members 110 may both be protrusions, and the first and second coupling features 140, 142 of the lower wedge members 130 may both be recesses, or vice versa. Although not shown, in at least one embodiment, the protrusions and the recesses may be dovetail-shaped.

Inner surfaces of the upper wedge members 110 may include seat features 126 that extend radially-inward therefrom. Together, the seat features 126 may define a circumferential seat that is configured to receive an obstructing member 160, as described in greater detail below.

Figure 5:
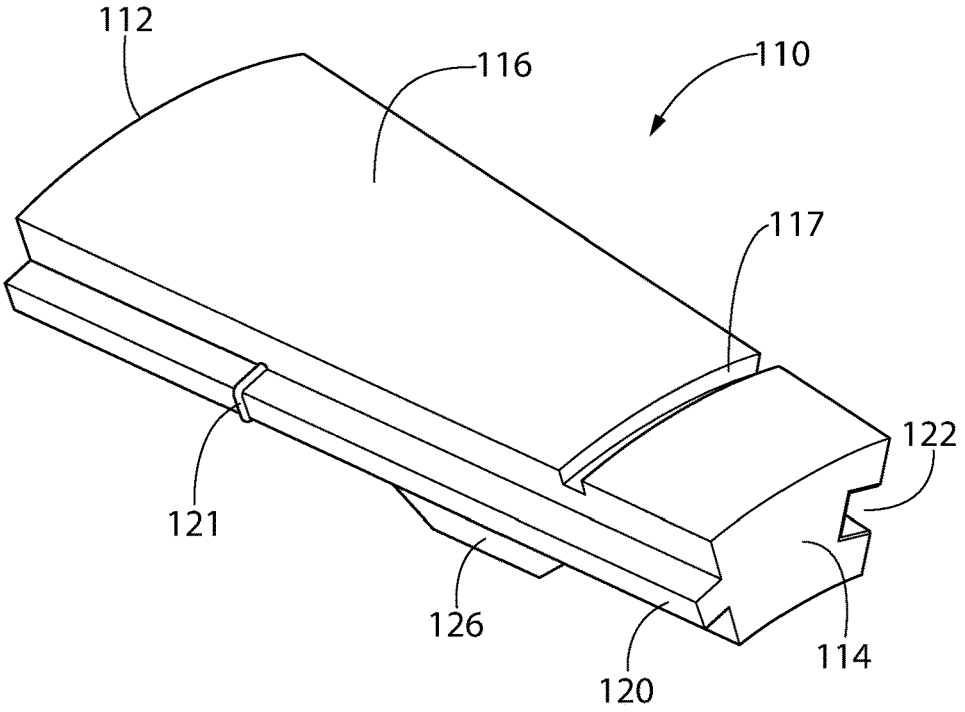
FIG. 5 illustrates a perspective view of a first (e.g., upper) wedge member of the downhole tool, according to an embodiment.

FIG. 5 illustrates a perspective view of an upper wedge member 110 of the downhole tool 100, according to an embodiment. As mentioned above, the outer surface 116 of the upper wedge member 110 may include the circumferential groove 117 for receiving the containment member 156, and the inner surface of the upper wedge member 110 may include the seat feature 126. The first coupling feature (e.g., protrusion) 120 may include one or more interference bumps (one is shown: 121). The interference bump 121 may form an interference/friction fit with the first coupling feature (e.g., recess) 140 of the corresponding lower wedge member 130 to help secure the upper wedge member 110 axially in place with respect to the corresponding lower wedge member 130. This may hold the downhole tool 100 in the second (e.g., set) state.

Figure 6:
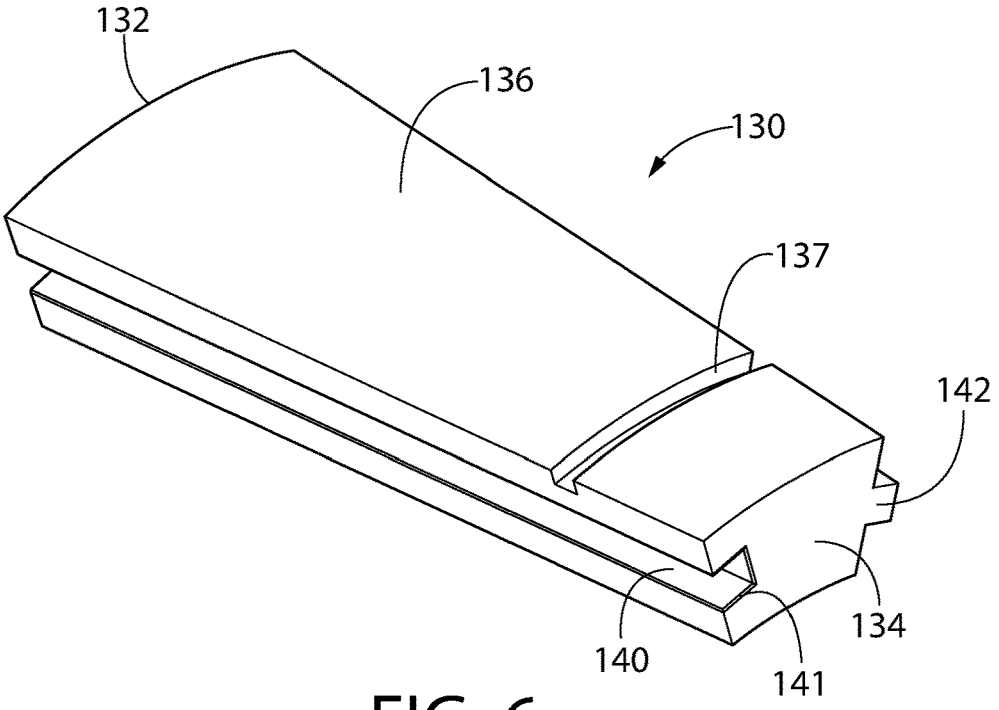
FIG. 6 illustrates a perspective view of a second (e.g., lower) wedge member of the downhole tool, according to an embodiment.

FIG. 6 illustrates a perspective view of a lower wedge member 130 of the downhole tool 100, according to an embodiment. The outer surface 136 of the lower wedge member 130 may also include the circumferential groove 137 for receiving the containment member 156. However, the inner surface of the lower wedge member 130 may not include the seat feature 126. Although not shown in FIG. 6, in some embodiment, the second coupling feature (e.g., protrusion) 142 of the lower wedge member 130 may also include one or more interference bumps (not shown). In at least one embodiment, an entrance into the first coupling feature (e.g., recess) 140 may include a beveled portion 141 to facilitate insertion of the interference bump 121 into the first coupling feature (e.g., recess) 140.

Figure 7:
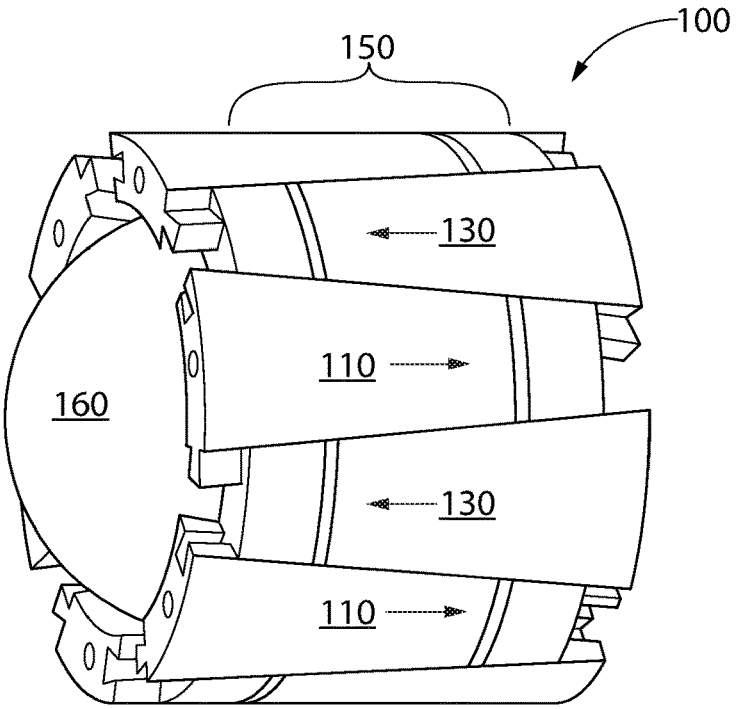
FIG. 7 illustrates a perspective view of the downhole tool in a second (e.g., set) state having an obstructing member positioned at least partially therein, according to an embodiment.
Figure 8:
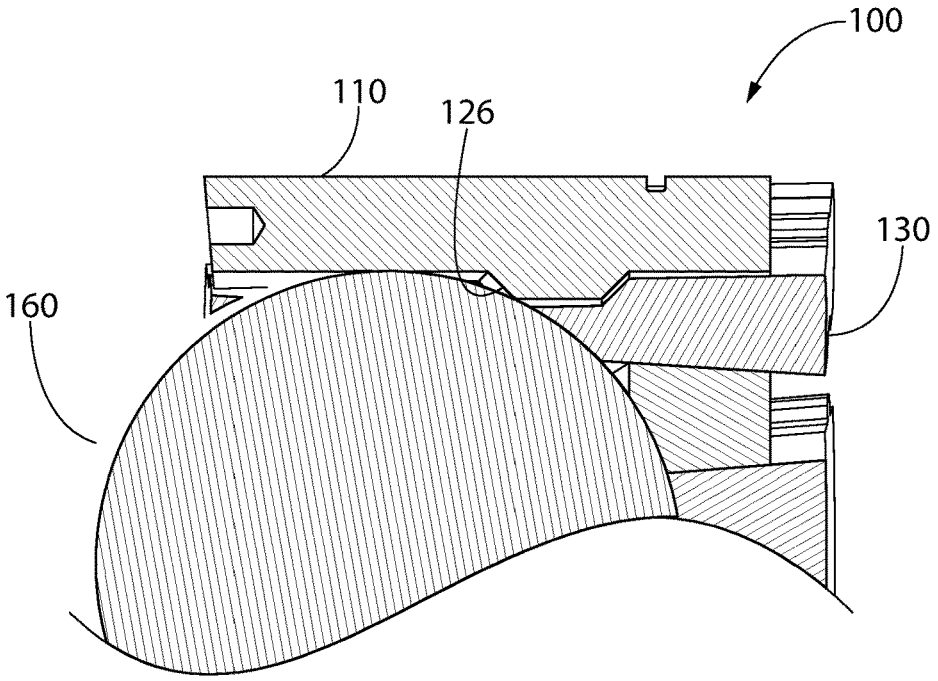
FIG. 8 illustrates a cross-sectional side view of the downhole tool in the second (e.g., set) state having the obstructing member positioned at least partially therein, according to an embodiment.

FIGS. 7 and 8 illustrate a perspective view and a partial cross-sectional side view of the downhole tool 100 in a second (e.g., set) state having an obstructing member 160 positioned at least partially therein, according to an embodiment. As described in greater detail below, when the downhole tool 100 actuates from the first (e.g., unset) state into the second (e.g., set) state, the upper wedge members 110 and the lower wedge members 130 may be axially-compressed and move axially-toward one another, as shown by the arrows in FIG. 7. This may decrease the overall length of the downhole tool 100 while increasing the length of the axially-overlapping portions 150. Due to the tapered shape of the upper and lower wedge members 110, 130, the axial movement of the upper and lower wedge members 110, 130 causes the diameter of the downhole tool 100 to increase, thereby moving the outer surfaces 116, 136 of the upper and lower wedge members 110, 130 radially-outward and into contact with the surrounding tubular.

The obstructing member 160 may be a ball that is received at least partially in the downhole tool 100 when the downhole tool 100 is in the second (e.g., set) state. More particularly, the obstructing member 160 may seat on the seat features 126 of the upper wedge members 110. When the obstructing member 160 is seated on the seat features 126 of the upper wedge members 110, the obstructing member 160 may form a seal with the inner surfaces of the upper and/or lower wedge members 110, 130. The seal may prevent fluid flow through the bore of the downhole tool 100 in a downward direction (e.g., to the right in FIG. 8).

When the pressure above the obstructing member 160 is increased, the obstructing member 160 may exert an increased downward force on the seat features 126 of the upper wedge members 110. This may cause the upper wedge members 110 to move downward with respect to the lower wedge members 130, thereby potentially further decreasing the overall length of the downhole tool 100, and increasing the length of the axially-overlapping portion 150 as the upper and/or lower wedge members 110, 130 are driven outwards, further into engagement with a surrounding tubular. This may increase the radially-outward gripping force exerted by the upper and lower wedge members 110, 130 on the surrounding tubular, such that the increased pressure serves to more securely anchor the downhole tool 100 in place in the surrounding tubular.

Figure 9:
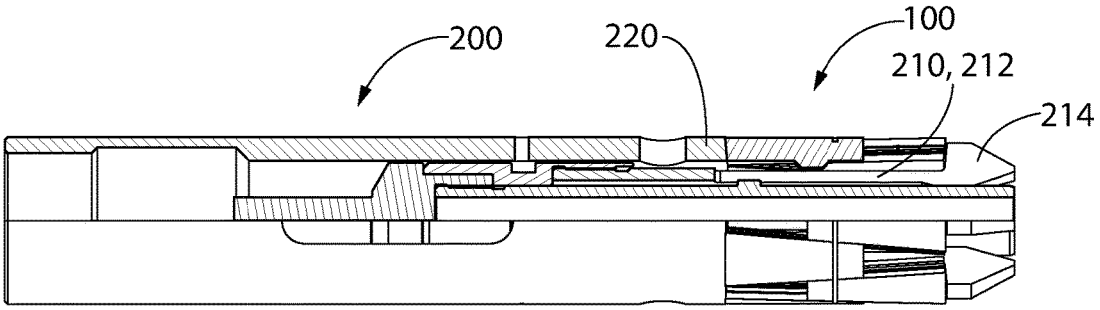
FIG. 9 illustrates a half-sectional side view of the downhole tool in the first (e.g., unset) state and positioned at least partially around the setting tool, according to an embodiment.
Figure 11:
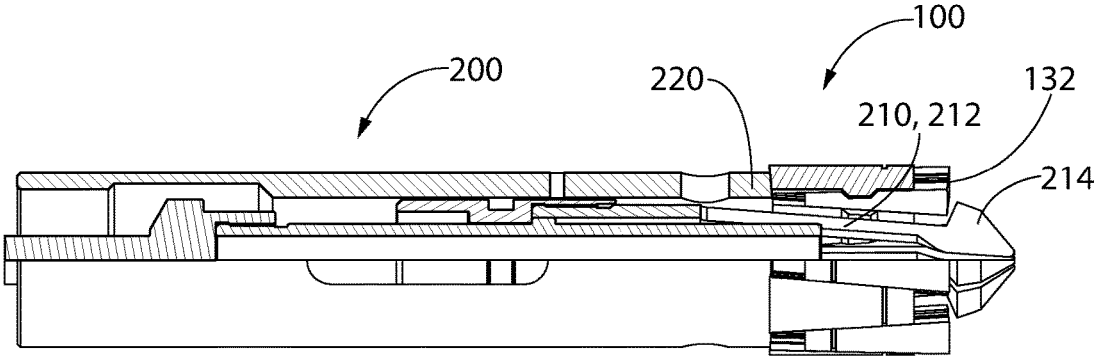
FIG. 11 illustrates a half-sectional side view of the downhole tool in the second (e.g., set) state and positioned at least partially around the setting tool, according to an embodiment.

FIG. 9 illustrates a half-sectional side view of the downhole tool 100 in the first (e.g., unset) state and positioned at least partially around the setting tool, according to an embodiment. The setting tool 200 may include a first (e.g., inner) portion 210 and a second (e.g., outer) portion 220. The inner portion 210 may extend through the bore of the downhole tool 100. More particularly, the inner portion 210 may include an arm 212 that extends-axially through the bore of the downhole tool 100. An end of the arm 212 may include a collet 214 that is positioned axially-below the downhole tool 100. The collet 214 may extend radially-outward and be configured to contact the outer axial ends 132 of the lower wedge members 130. In one example, the inner portion 210 may include a plurality of arms 212 that are circumferentially-offset from one another, and each arm 212 may include a collet 214. The outer portion 220 of the setting tool 200 may be configured to contact the outer axial ends 112 of the upper wedge members 110.

Figure 10:
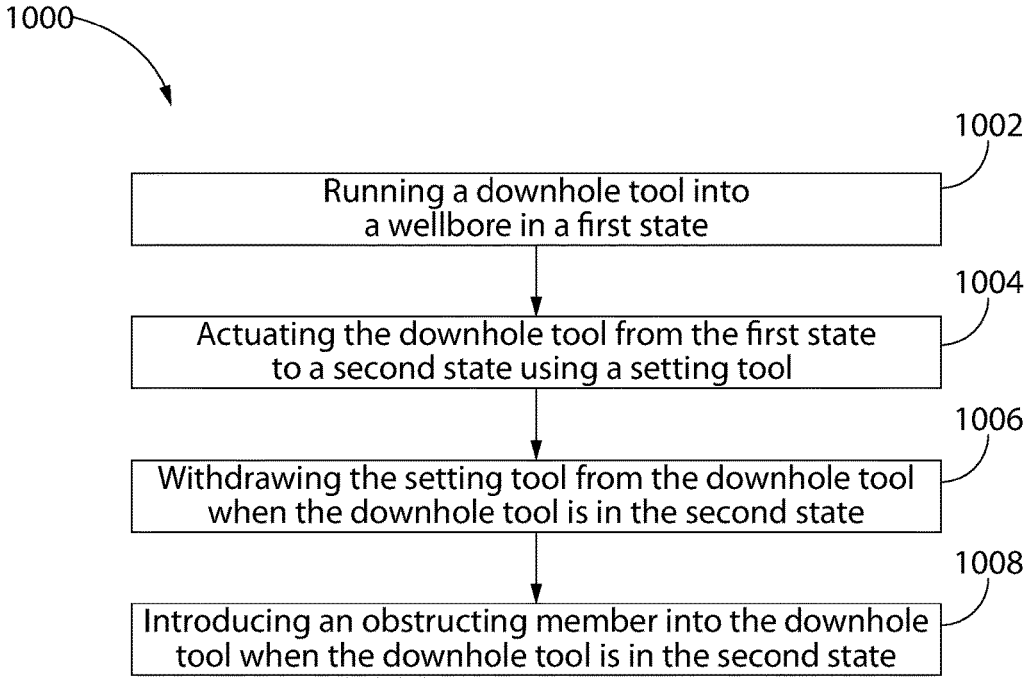
FIG. 10 illustrates a flowchart of a method for actuating the downhole tool from the first (e.g., unset) state to the second (e.g., set) state, according to an embodiment.

FIG. 10 illustrates a flowchart of a method 1000 for actuating the downhole tool 100 from the first (e.g., unset) state to the second (e.g., set) state, according to an embodiment. FIGS. 9 and 11-14 illustrate various stages of the method 1000. Although the method 1000 is described herein with reference to the tool 100, it will be appreciated that some embodiments of the method 1000 may be executed using a different tool, and thus the method 1000 is not limited to any particular structure unless otherwise stated herein.

The method 1000 may begin by running the downhole tool 100 into a wellbore in the first (e.g., unset) state, as at 1002. This is shown in FIG. 9. The downhole tool 100 may be run into the wellbore on the setting tool 200.

When the downhole tool 100 is in the desired location in the wellbore, the method 1000 may include actuating the downhole tool 100 from the first (e.g., unset) state into the second (e.g., set) state using the setting tool 200, as at 1004. The downhole tool 100 is shown in the second (e.g., set) state in FIG. 11. To actuate the downhole tool 100, the user may cause the setting tool 200 to exert opposing axial forces on the downhole tool 100. More particularly, the inner portion 210 of the setting tool 200 may exert an axial force on the lower wedge members 130 in a first (e.g., upward) axial direction, and the outer portion 220 of the setting tool 200 may exert an axial force on the upper wedge members 110 in a second (e.g., downward) axial direction. As discussed above, these opposing forces may axially-compress the upper and lower wedge members 110, 130, causing the upper and lower wedge members 110, 130 to move axially-toward one another, which may, in turn, cause the upper and lower wedge members 110, 130 to expand radially-outward and into contact with the surrounding tubular.

Figure 12:
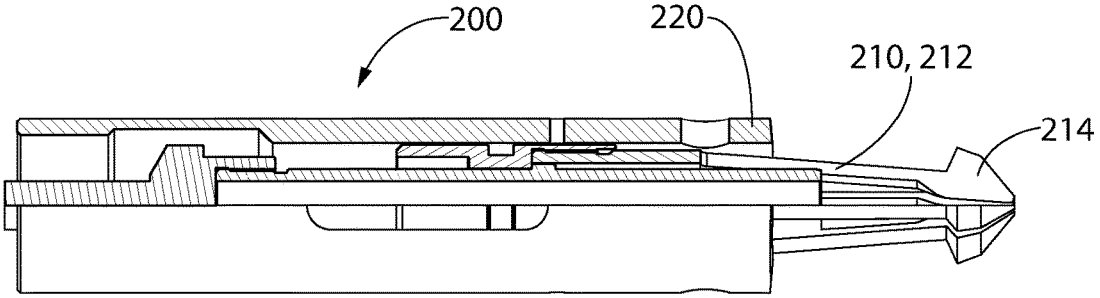
FIG. 12 illustrates a half-sectional side view of the setting tool after being withdrawn from the downhole tool, according to an embodiment.

The method 1000 may then include withdrawing the setting tool 200 from the downhole tool 100 after the downhole tool 100 is in the second (e.g., set) state, as at 1006. After the downhole tool 100 is set, the user may increase the axial force exerted on the lower wedge members 130 in the first (e.g., upward) axial direction. This may cause the inner portion 210 of the setting tool 200 to bend/deflect radially-inward. The inner portion 210 of the setting tool 200 is beginning to bend/deflect radially-inward in FIG. 11. When the outer diameter of the collets 214 becomes less than or equal to the inner diameter of the downhole tool 100, the inner portion 210 may be pulled upward through the bore of the downhole tool 100 to withdraw the setting tool 200 from the downhole tool 100. This is shown in FIG. 12. The setting tool 200 may then be pulled back to the surface.

Figure 13:
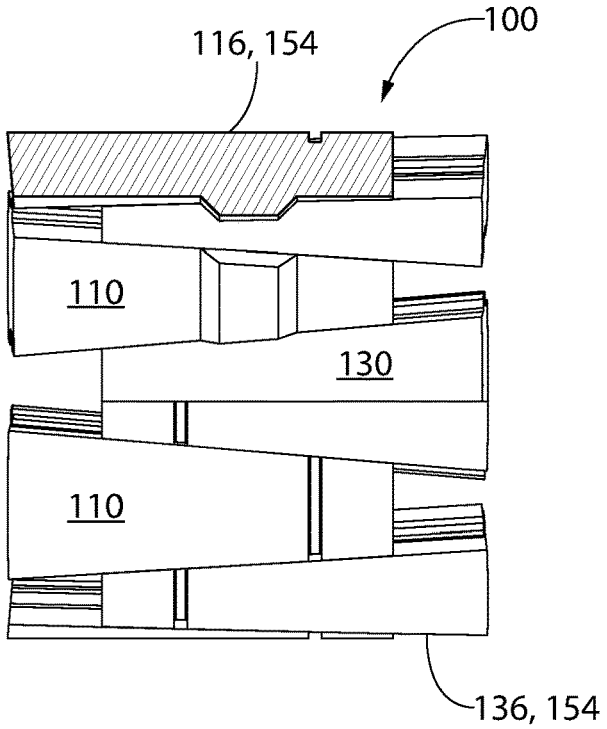
FIG. 13 illustrates a half-sectional side view of the downhole tool in the second (e.g., set) state after the setting tool has been withdrawn, according to an embodiment.

The downhole tool 100 remains in the wellbore in the second (e.g., set) state. This is shown in FIG. 13. More particularly, the outer surfaces of the upper and lower wedge members 110, 130 may be in contact with the surrounding tubular. The gripping feature 154 on the outer surfaces of the upper and lower wedge members 110, 130 may help secure the downhole tool 100 in place in the surrounding tubular.

Figure 14:
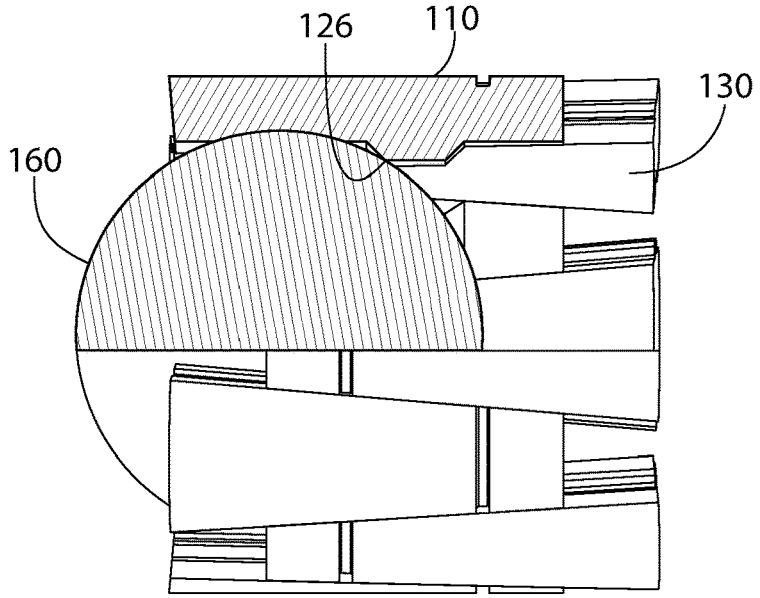
FIG. 14 illustrates a half-sectional side view of the downhole tool in the second (e.g., set) state after the setting tool has been withdrawn and the obstructing member has been introduced into the downhole tool, according to an embodiment.

The method 1000 may then include introducing the obstructing member 160 into the downhole tool 100 when the downhole tool 100 is in the second (e.g., set) state in the wellbore, as at 1008. This is shown in FIG. 14. More particularly, the user may drop the obstructing member 160 into the wellbore from the surface, and the obstructing member 160 may come to rest on the seat features 126 of the upper wedge members 110. As discussed above, the obstructing member 160 may prevent fluid from flowing downward through the bore of the downhole tool 100. The obstructing member 160 may also increase the radially-outward gripping force exerted by the downhole tool 100.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a plurality of upper wedge members; and a plurality of lower wedge members, wherein each of the upper wedge members and each of the lower wedge members have a circumferential width that decreases proceeding from an outer axial end thereof to an inner axial end thereof, each the upper wedge members being positioned circumferentially-between two of the lower wedge members, wherein an inner surface of each of the upper wedge members comprises a shoulder, the shoulders of the upper wedge members together providing a seat feature that protrudes inwardly and is configured to receive an obstructing member, wherein the lower wedge members do not include the seat feature, such that the seat feature is discontinuous as proceeding circumferentially around the downhole tool, and wherein, as the downhole tool actuates from a first state to a second state:

the upper and lower wedge members move axially with respect to a central longitudinal axis through the downhole tool;

the upper and lower wedge members move radially-outward with respect to the central longitudinal axis; and the upper and lower wedge members remain coupled to one another as the upper and lower wedge members move.

2. The downhole tool of claim 1, wherein a first side of at least one of the upper wedge members comprises a first coupling feature, wherein a first side of at least one of the lower wedge members comprises a second coupling feature, and wherein the first and second coupling features couple the upper and lower wedge members together.

3. The downhole tool of claim 2, wherein the first side of the at least one of the upper wedge members comprises a first circumferential side thereof with respect to the central longitudinal axis.

4. The downhole tool of claim 2, wherein the first coupling feature comprises a protrusion, and wherein the second coupling feature comprises a recess.

5. The downhole tool of claim 4, wherein the first coupling feature comprises an interference bump.

6. The downhole tool of claim 1, wherein an outer surface of at least one of the upper wedge members, at least one of the lower wedge members, or both comprises a gripping feature.

7. The downhole tool of claim 1, wherein an outer surface of at least one of the upper wedge members, at least one of the lower wedge members, or both defines at least a portion of a circumferential groove.

8. The downhole tool of claim 1, wherein the upper wedge members each at least partially axially-overlap with a respective one of the lower wedge members in the first and second states, and wherein an amount that the upper and lower wedge members at least partially axially-overlap increases proceeding from the first state to the second state.

9. The downhole tool of claim 1, wherein the inner axial ends of the upper and lower wedge members face in opposing axial directions.

10. The downhole tool of claim 1, wherein the inner surface of the upper wedge members and an inner surface of the lower wedge members are each configured to engage and seal with the obstructing member, when the obstructing member is seated on the seat feature.

11. A downhole tool, comprising:

a plurality of upper wedge members; and a plurality of lower wedge members, wherein each of the upper wedge members is positioned circumferentially-between two of the lower wedge members, wherein each of the upper and lower wedge members has a circumferential width that decreases proceeding from an outer axial end thereof to an inner axial end thereof, wherein an inner surface of each of the upper wedge members comprises a shoulder, the shoulders of the upper wedge members together providing a seat feature that protrudes inwardly and is configured to receive an obstructing member, wherein the lower wedge members do not provide part of the seat feature, such that the seat feature is discontinuous as proceeding circumferentially around the downhole tool, and wherein, as the downhole tool actuates from a first state to a second state:

the upper and lower wedge members move axially with respect to a central longitudinal axis through the downhole tool such that a length of the downhole tool decreases;

the upper and lower wedge members move radially-outward with respect to the central longitudinal axis such that a diameter of the downhole tool increases; and the upper and lower wedge members remain coupled to one another one another as the upper and lower wedge members move.

12. The downhole tool of claim 11, wherein a first circumferential side of a first of the upper wedge members comprises a first coupling feature, wherein a first circumferential side of a first of the lower wedge member comprises a second coupling feature, and wherein the first and second coupling features couple the upper and lower wedge members together.

13. The downhole tool of claim 11, wherein the upper and lower wedge members at least partially axially-overlap in the first and second states, wherein outer surfaces of the upper and lower wedge members define portions of a circumferential groove, and wherein the portions of the circumferential groove are aligned when the downhole tool is in the first state to form a continuous circumferential groove.

14. The downhole tool of claim 13, further comprising a containment member positioned in the continuous circumferential groove when the downhole tool is in the first state, wherein the containment member is configured to break when the downhole tool actuates into the second state.

15. A method for actuating a downhole tool in a wellbore, comprising:

running the downhole tool into the wellbore in a first state, wherein the downhole tool comprises:

a plurality of upper wedge members; and a plurality of lower wedge members, wherein each of the upper wedge members is positioned circumferentially-between two of the lower wedge members, wherein each of the upper and lower wedge members has a circumferential width that decreases proceeding from an outer axial end thereof to an inner axial end thereof;

actuating the downhole tool from a first state into a second state by exerting a downward axial force on the upper wedge members and an upward axial force on the lower wedge members, wherein, as the downhole tool actuates from the first state to the second state:

the upper and lower wedge members move axially with respect to a central longitudinal axis through the downhole tool such that a length of the downhole tool decreases;

the upper and lower wedge members move radially-outward with respect to the central longitudinal axis such that a diameter of the downhole tool increases; and the upper and lower wedge members remain coupled to one another one another as the upper and lower wedge members move; and introducing an obstructing member into the wellbore, wherein an inner surface of each of the upper wedge members comprises a shoulder, the shoulders of the upper wedge members together providing a seat feature that protrudes inwardly and is configured to receive the obstructing member, wherein the lower wedge members do not include the seat feature, such that the seat feature is discontinuous as proceeding circumferentially around the downhole tool, and wherein the obstructing member, when seated on the seat feature, prevents fluid flow through the downhole tool in one axial direction.

16. The method of claim 15, wherein the downhole tool is positioned at least partially around a setting tool when the downhole tool is run into the wellbore, and wherein the setting tool exerts the downward axial force on the upper wedge members and the upward axial force on the lower wedge members.

17. The method of claim 16, further comprising withdrawing the setting tool from the downhole tool when the downhole tool is in the second state.

18. The method of claim 15, wherein the obstructing member also causes the upper and lower wedge members to move radially-outward even farther to increase a radially-outward gripping force exerted by the downhole tool against a surrounding tubular member.

* * * * *